US011049643B1

(12) United States Patent
Folker et al.

(10) Patent No.: US 11,049,643 B1
(45) Date of Patent: Jun. 29, 2021

(54) COMBINED U-CORE MAGNETIC STRUCTURE

(71) Applicant: UNIVERSAL LIGHTING TECHNOLOGIES, INC., Madison, AL (US)

(72) Inventors: Donald Folker, Madison, AL (US); Mike LeBlanc, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 205 days.

(21) Appl. No.: 16/048,976

(22) Filed: Jul. 30, 2018

Related U.S. Application Data

(60) Provisional application No. 62/563,259, filed on Sep. 26, 2017.

(51) Int. Cl.

| | |
|---|---|
| ***H01F 27/24*** | (2006.01) |
| ***H01F 27/26*** | (2006.01) |
| ***H01F 41/02*** | (2006.01) |
| ***H01F 27/32*** | (2006.01) |
| *H01F 27/29* | (2006.01) |

(52) U.S. Cl.
CPC ..... *H01F 27/26* (2013.01); *H01F 27/325* (2013.01); *H01F 41/0206* (2013.01); *H01F 27/29* (2013.01)

(58) Field of Classification Search
CPC ..... H01F 27/325
USPC ..... 336/198, 212, 221
See application file for complete search history.

(56) References Cited

U.S. PATENT DOCUMENTS

| | | | | |
|---|---|---|---|---|
| 4,454,557 | A * | 6/1984 | Hurley | G01R 15/005 324/127 |
| 4,622,627 | A * | 11/1986 | Rodriguez | H01F 27/022 361/782 |
| 4,864,478 | A * | 9/1989 | Bloom | H01F 3/10 363/16 |
| 5,550,437 | A * | 8/1996 | Hopkins | H05B 41/391 315/209 R |
| 2004/0140775 | A1* | 7/2004 | Baumann | H01F 41/02 315/307 |
| 2004/0246089 | A1* | 12/2004 | Stephens | H02M 3/33569 336/212 |
| 2008/0169769 | A1* | 7/2008 | Lee | H05B 41/2822 315/278 |
| 2008/0278274 | A1* | 11/2008 | Kang | H01F 27/06 336/198 |

* cited by examiner

*Primary Examiner* — Ronald Hinson
(74) *Attorney, Agent, or Firm* — Patterson Intellectual Property Law, P.C.; Gary L. Montle; Jerry Turner Sewell

(57) ABSTRACT

A magnetic connector assembly has two independent magnetic components sharing a common core structure. The magnetic assembly includes first and second bobbins, and includes a magnetic core. The magnetic core includes first and second core halves, each half including a main core body, a first outer leg, a second outer leg, and a middle leg. The first outer leg fits within a passageway of the first bobbin. The second outer leg fits within a passageway of the second bobbin. The middle leg fits between the two bobbins.

10 Claims, 12 Drawing Sheets

COMBINED U-CORE MAGNETIC STRUCTURE

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of priority of U.S. Provisional Application No. 62/563,259 filed Sep. 26, 2017, entitled "Combined U Core Magnetic Structure," which is incorporated by reference herein in its entirety.

FIELD OF THE INVENTION

The present disclosure relates generally to transformers and methods for making transformers. More particularly, the present disclosure relates to magnetic assemblies having multiple independent magnetic components.

BACKGROUND

In a conventional electronic system that includes magnetic components, each magnetic component comprises a respective core, a respective bobbin and at least one respective winding positioned on the bobbin. For example, FIGS. 1A and 1B illustrate a portion of a conventional printed circuit board 100 having a first magnetic assembly 110 and a second magnetic assembly 112. Each magnetic assembly 110, 112 in FIGS. 1A and 1B has respective E-shaped core halves. Each magnetic assembly may be a transformer, a choke (or inductor) or another type of magnetic component having a winding and a core.

The first magnetic assembly 110 comprises a bobbin 120A having a first pin rail 122A and a second pin rail 124A. Each pin rail supports a plurality of terminal pins 126A. At least two of the terminal pins are electrically connected to a winding 130A, which is wound about a passageway 132A having a first end 134A and a second end 136A. The first end of the passageway receives a middle leg 142A of a first core half 140A. A first outer leg 144A of the first core half extends along a first side of the bobbin in parallel with the passageway. A second outer leg 146A of the first core half extends along a second side of the bobbin in parallel with the passageway. The second end of the passageway receives a middle leg 152A of a second core half 150A. Respective ends (not shown) of the first middle legs of the first and second core halves are adjacent within the passageway. In certain embodiments, the ends are spaced apart by a selected distance to provide an air gap in the magnetic path formed by the two middle legs. A first outer leg 154A of the second core half extends along the first side of the bobbin in parallel with the passageway. A second outer leg 156A of the second core half extends along the second side of the bobbin in parallel with the passageway. In the illustrated embodiment, the respective ends of the corresponding outer legs along the sides of bobbin abut to form a continuous magnetic path from the middle legs and around the outside of the bobbin.

The second magnetic assembly 112 comprises a bobbin 120B having a first pin rail 122B and a second pin rail 124B. Each pin rail supports a plurality of terminal pins 126B. At least two of the terminal pins are electrically connected to a winding 130B, which is wound about a passageway 132B having a first end 134B and a second end 136B. The first end of the passageway receives a middle leg 142B of a first core half 140B. A first outer leg 144B of the first core half extends along a first side of the bobbin in parallel with the passageway. A second outer leg 146B of the first core half extends along a second side of the bobbin in parallel with the passageway. The second end of the passageway receives a middle leg 152B of a second core half 150B. Respective ends (not shown) of the first middle legs of the first and second core halves are adjacent within the passageway. In certain embodiments, the ends are spaced apart by a selected distance to provide an air gap in the magnetic path formed by the two middle legs. A first outer leg 154B of the second core half extends along the first side of the bobbin in parallel with the passageway. A second outer leg 156B of the second core half extends along the second side of the bobbin in parallel with the passageway. In the illustrated embodiment, the respective ends of the corresponding outer legs along the sides of bobbin abut to form a continuous magnetic path from the middle legs and around the outside of the bobbin.

As shown in FIGS. 1A and 1B, each of the first magnetic assembly 110 and the second magnetic assembly 112 occupies a respective area on an upper surface 160 of the printed circuit board 100. In addition to the minimum area required to accommodate the nominal peripheral dimensions of the respective magnetic assembly, additional space must be provided between each adjacent magnetic assembly to provide allowance for tolerances in the peripheral dimensions. Furthermore, in order to allow the magnetic assemblies to be automatically positioned on the printed circuit board (e.g., by using pick-and-place equipment), sufficient spaced must be provided between adjacent magnetic assemblies to allow the positioning equipment to engage the sides of the assemblies.

BRIEF SUMMARY

Accordingly, a need exists for a magnetic assembly that combines multiple magnetic components into a single component that can be positioned within a smaller surface area on a printed circuit board than the area occupied by the multiple magnetic components.

One embodiment disclosed herein is a magnetic core for simultaneous use with two independent magnetic bobbins. The magnetic core comprises a first core half and a second core half. Each of the first core half and the second core half includes a main core body, a first outer leg, a second outer leg, and a middle leg. The main core body extends between a first end surface of the main core body and a second end surface of the main core body. The main core body has a main core outer surface, a first main core inner surface, and a second main core inner surface. The first and second main core inner surfaces are positioned opposite the main core outer surface. The first outer leg extends perpendicularly from the inner surface of the main core body. The first outer leg is positioned proximate to the first end surface of the main core body. The first outer leg has a first outer leg length defined between the first main core inner surface and a first outer leg end surface of the first outer leg. The first outer leg has a first outer leg cross-sectional profile which includes a first outer leg cross-sectional area. The second outer leg extends perpendicularly from the inner surface of the main core body. The second outer leg is positioned proximate to the second end surface of the main core body. The second outer leg has a second outer leg length defined between the second main core inner surface and a second outer leg end surface of the second outer leg. The second outer leg has a second outer leg cross-sectional profile which includes a second outer leg cross-sectional area. The middle leg extends perpendicularly from the inner surface of the main core body, the middle leg is positioned between the first outer leg and the second outer leg. The middle leg is spaced apart from the first outer leg by a first width and is spaced apart from the second outer leg by a second width. The middle leg has a middle leg end surface positioned at least as far as each of the first and second outer leg end surfaces are from the main core outer surface. The middle leg has a middle leg cross-sectional profile which includes a middle leg cross-sectional area. The middle leg cross-sectional area is at least as great as the sum of the first outer leg cross-sectional area and the second outer leg cross-sectional area.

In certain embodiments, the main core body has a first thickness and a second thickness. The first thickness is defined between the main core outer surface and the first main core inner surface. The second thickness is defined between the main core outer surface and the second main core inner surface. The first thickness is at least as great as the second thickness.

In certain embodiments, the main core body has a first main core body cross-sectional area and a second main core body cross-sectional area. The first main core body cross-sectional area is defined between the main core outer surface and the first main core inner surface. The first main core body cross-sectional area is greater than or equal to the first outer leg cross-sectional area. The second main core body cross-sectional area is defined between the man core outer surface and the second main core inner surface. The second main core body cross-sectional area is greater than or equal to the second outer leg cross-sectional area.

In certain embodiments, the first outer leg end surface of the first core half is spaced apart from the first outer leg end surface of the second core half by a first gap distance.

In certain embodiments, the second outer leg end surface of the first core half is spaced apart from the second outer leg end surface of the second core half by a second gap distance.

In certain embodiments, the first outer leg is configured to fit within a passageway of the first bobbin, and the second outer leg is configured to fit within a passageway of the second bobbin.

Another embodiment disclosed herein is a magnetic assembly having two independent magnetic components sharing a common core structure. The magnetic assembly comprises a first bobbin, a second bobbin, a first core half, and a second core half. The first bobbin includes a first winding configured to surround a respective passageway of the first bobbin. The first bobbin further includes a respective first end flange and a respective second end flange positioned at opposite ends of the passageway. The passageway of the first bobbin has a respective passageway length defined between a respective outer surface of the first end flange and a respective outer surface of the second end flange. The second bobbin includes a second winding configured to surround a respective passageway of the second bobbin. The second bobbin further includes a respective first end flange and a respective second end flange positioned at opposite ends of the passageway. The passageway of the second bobbin has a respective passageway length defined between a respective outer surface of the first end flange and a respective outer surface of the second end flange. Each of the first core half and the second core half includes a main core body, a first outer leg, a second outer leg, and a middle leg. The main core body extends between a first end surface of the main core body and a second end surface of the main core body. The first outer leg extends perpendicularly from an inner surface of the main core body and is positioned proximate to the first end surface of the main core body. The first outer leg has a first outer leg cross-sectional profile configured to fit within the passageway of the first bobbin. The first outer leg cross-sectional profile defines a first outer leg cross-sectional area. The second outer leg extends perpendicularly from the inner surface of the main core body and is positioned proximate to the second end surface of the main core body. The second outer leg has a second outer leg cross-sectional profile configured to fit within the passageway of the second bobbin. The second outer leg cross-sectional profile defines a second outer leg cross-sectional area. The middle leg extends perpendicularly from the inner surface of the main core body between the first outer leg and the second outer leg. The middle leg is spaced apart from the first outer leg by a first window width and is spaced apart from the second outer leg by a second window width. The middle leg has a middle leg end surface. The middle leg further has a middle leg cross-sectional profile which defines a middle leg cross-sectional area. The middle leg cross-sectional area is at least as great as the sum of the first outer leg cross-sectional area and the second outer leg cross-sectional area.

In certain embodiments, the first outer leg of each core half is configured to be inserted into the passageway of the first bobbin, and the second outer leg of each core half is configured to be inserted into the passageway of the second bobbin. The middle leg of each core half is configured to span between the first bobbin and the second bobbin with the middle led end surface of the first core half abutting the middle leg end surface of the second core half.

In certain embodiments, each of the first and second end flanges of the first bobbin include a first flange width defined between the passageway and a lateral outer periphery of the respective end flange. The first bobbin flange width is less than the first window width. Each of the first and second end flanges of the second bobbin includes a second bobbin flange width defined between the passageway and a lateral outer periphery of the respective end flange. The second bobbin flange width is less than the second window width.

In certain embodiments, the main core body, the first outer leg, the second outer leg, and the middle leg of each of the first and second core halves have a selected common height.

In certain embodiments, the first outer legs and the middle legs of the first and second core halves define a first winding window. The first winding window includes the first window width and a first window length. The first window length is defined between a respective first main core inner surface of the main core body of the first core half and a respective first main core inner surface of the main core body of the second core half when the first and second core halves are mated. A second winding window is defined between the middle legs and the second outer legs of the first and second core halves. The second winding window including the second window width and a second window length. The second window length is defined between a respective second main core inner surface of the main core body of the first core half and a respective second main core inner surface of the main core body of the second core half when the first and second core halves are mated.

In certain embodiments, the first window length is at least as great as the passageway length of the passageway of the first bobbin. Also, the second window length is at least as great as the passageway length of the passageway of the second bobbin.

In certain embodiments, the main core body of each of the first core half and second core half includes a main core outer surface, a first main core inner surface, and a second main core inner surface. The first and second main core inner surfaces are positioned opposite to the main core outer surface. The first main core inner surface is defined between the first outer leg and the middle leg. The second main core inner surface is defined between the middle leg and the second outer leg. The middle leg of each of the first and second core halves includes a middle leg end surface, a first common length, and a second common length. The first common length is defined between the first main core inner surface and the middle leg end surface. The second common length is defined between the second main core inner surface and the middle leg end surface. The first outer leg of each of the first and second core halves includes a first outer leg end surface and a third common length. The third common length is defined between the first main core inner surface and the first outer leg end surface. The second outer leg of each of the first and second core halves includes a second outer leg end surface and a fourth common length. The fourth common length is defined between the second main core inner surface and the second outer leg end surface.

In certain embodiments, the first common length is greater than the third common length by one-half of a first gap distance. The first gap distance is defined between the first outer leg end surface of the first core half and the first outer leg end surface of the second core half.

In certain embodiments, the second common length is greater than the fourth common length by one-half of a second gap distance. The second gap distance is defined between the second outer leg end surface of the first core half and the second outer leg end surface of the second core half.

Another embodiment disclosed herein is a method of assembling a magnetic assembly having two independent magnetic components sharing a common core structure. The method includes the step of providing a first bobbin and a second bobbin. Each bobbin has a respective passageway and at least one respective winding wound around the respective passageway. Each passageway has a respective first end and a respective second end. The passageway of the first bobbin is parallel to the passageway of the second bobbin.

The method further includes the step of engaging a first core half with the first bobbin and the second bobbin by positioning a first outer leg of the first core half into the first end of the passageway of the first bobbin, positioning a second outer leg of the first core half into the first end of the passageway of the second bobbin, and positioning the middle of the first core half between the first bobbin and the second bobbin. The first outer leg of the first core half has a respective first outer leg cross-sectional area. The second outer leg of the first core half has a respective second outer leg cross-sectional area. The middle leg of the first core half has a respective middle leg cross-sectional area. The middle leg cross-sectional area is at least as great as the sum of the first outer leg cross-sectional area of the first core half and the second outer leg cross-sectional area of the second core half.

The method further includes the step of engaging a second core half with the first bobbin and the second bobbin by positioning a first outer leg of the second core half into the second end of the passageway of the first bobbin, positioning a second outer leg of the second core half into the second end of the passageway of the second bobbin, and positioning the middle of the second core half between the first bobbin and the second bobbin. The first outer leg of the second core half has a respective first outer leg cross-sectional area that is substantially equal to the first outer leg cross-sectional area of the first core half. The second outer leg of the second core half has a respective second outer leg cross-sectional area that is substantially equal to the second outer leg cross-sectional area of the first core half. The middle leg of the second core half abuts the middle leg of the first core half. The middle leg of the second core half has a respective middle leg cross-sectional area that is substantially equal to the middle leg cross-sectional area of the first core half.

In certain embodiments, the method further includes the step of selecting a first common length of the middle leg of each of the first core half and the second core half. The combined first common lengths of the middle legs of the first core half and the second core half are at least as great as a passageway length of the passageway of the first bobbin. The method further includes the step of selecting a second common length of the middle leg of each of the first core half and the second core half. The combined second common lengths of the middle legs of the first core half and the second core half are at least as great as a passageway length of the passageway of the second bobbin.

In certain embodiments, the passageway length of the second bobbin differs from the passageway length of the first bobbin.

In certain embodiments, the method further includes the step of selecting a third common length of the first outer leg of each of the first core half and second core half. The third common length is less than the first common length.

In certain embodiments, the method further includes the step of selecting a fourth common length of the second outer leg of each of the first core half and second core half. The fourth common length is less than the second common length.

DETAILED DESCRIPTION

In the following description, various dimensional and orientation words, such as height, width, length, longitudinal, horizontal, vertical, up, down, left, right, tall, low profile, and the like, may be used with respect to the illustrated drawings. Such words are used for ease of description with respect to the particular drawings and are not intended to limit the described embodiments to the orientations shown. It should be understood that the illustrated embodiments can be oriented at various angles and that the dimensional and orientation words should be considered relative to an implied base plane that would rotate with the embodiment to a revised selected orientation.

Reference will now be made in detail to embodiments of the present disclosure, one or more drawings of which are set forth herein. Each drawing is provided by way of explanation of the present disclosure and is not a limitation. It will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

It is intended that the present disclosure covers such modifications and variations as come within the scope of the appended claims and their equivalents. Other objects, features, and aspects of the present disclosure are disclosed in the following detailed description. It is to be understood by one of ordinary skill in the art that the present discussion is a description of exemplary embodiments only and is not intended as limiting the broader aspects of the present disclosure.

FIGS. 2-12 illustrate a single magnetic assembly 200 that includes a first (leftmost) magnetic component 210 and a second (rightmost) magnetic component 212 on a single core structure 214. The single magnetic assembly is mounted on a printed circuit board (PCB) 216 in FIG. 2. The magnetic assembly is shown prior to mounting on the PCB in FIGS. 3-11.

Figure 3:
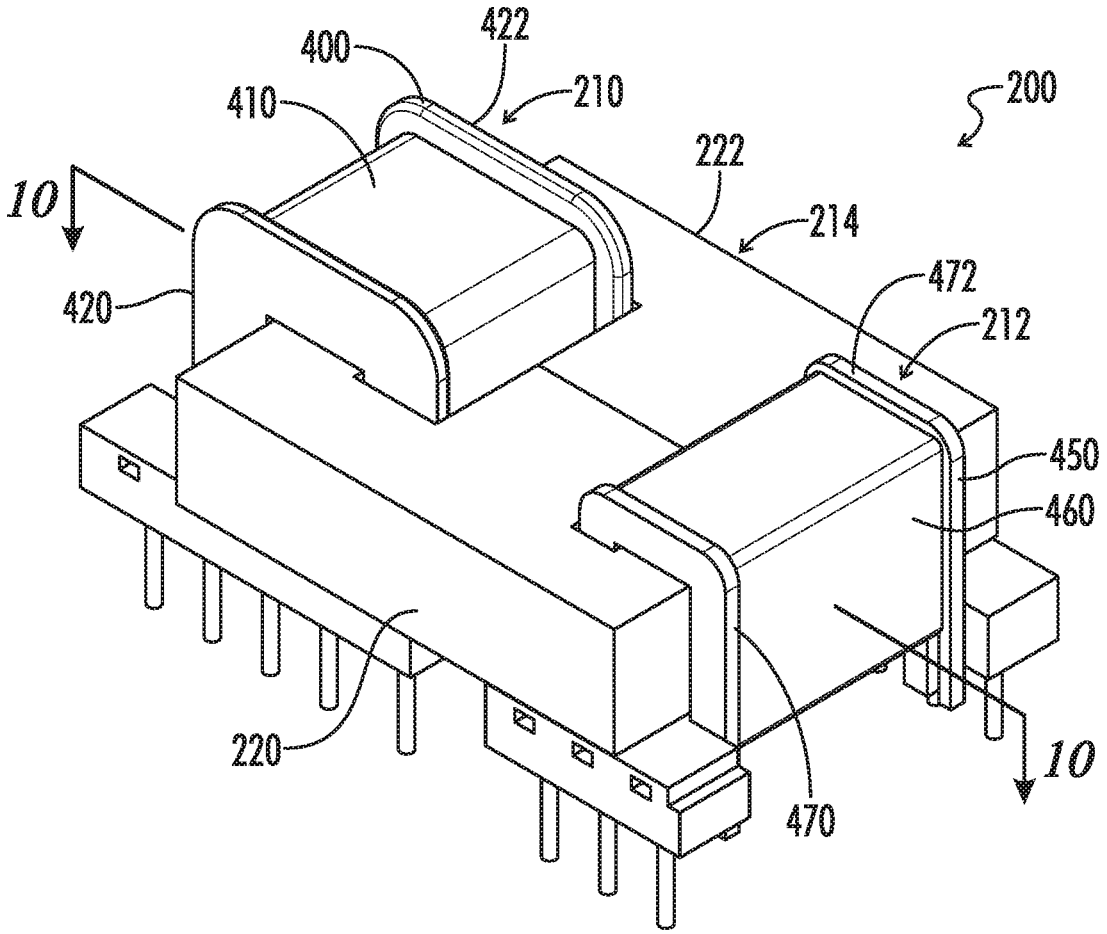
FIG. 3 illustrates an upper front perspective view of the single magnetic assembly of FIG. 2 prior to installation on the printed circuit.
Figure 4:
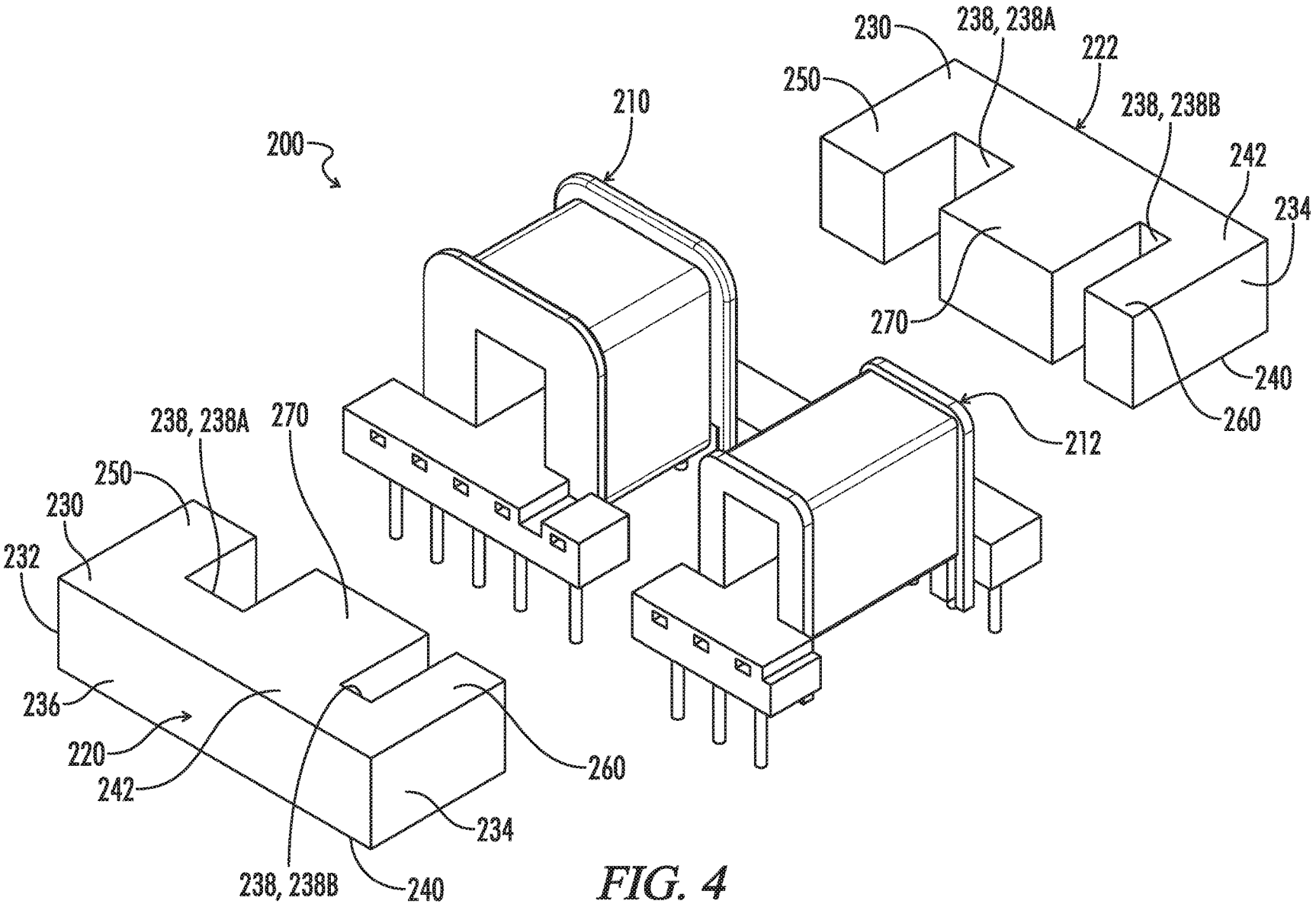
FIG. 4 illustrates an exploded upper front perspective view of the single magnetic assembly of FIG. 3.

As shown in FIGS. 3 and 4, for example, the magnetic assembly 200 comprises a first core half 220 and a second core half 222. In the illustrated embodiment, the first core half and the second core half are identical or are substantially identical and are positioned in the single magnetic assembly in a mirrored orientation. Each of the first core half and the second core half of the single core structure has a general appearance similar to a conventional E-core half; however, the outer legs are inserted into two separate bobbins rather than surrounding a single bobbin, as further described below.

Figure 5:
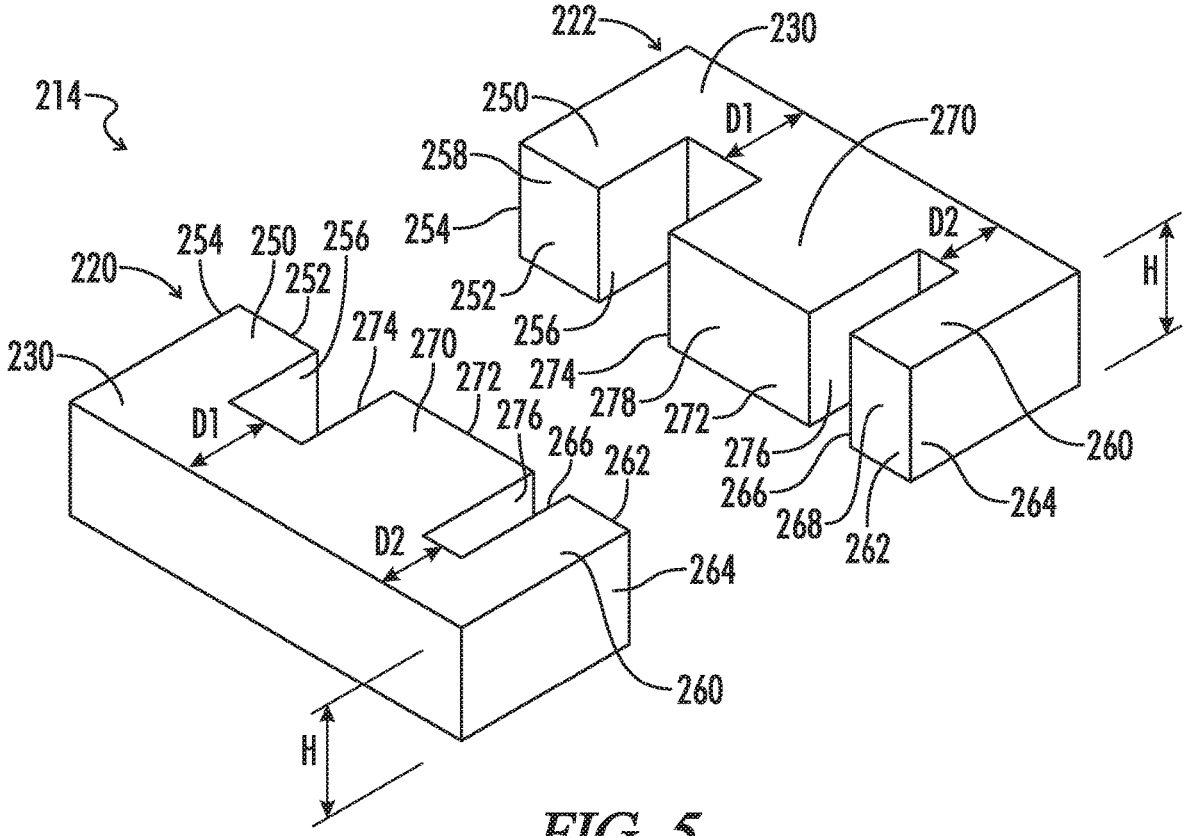
FIG. 5 illustrates upper front perspective view of the first core half and the second core half of the core structure of the magnetic assembly of FIG. 3.

As shown in FIGS. 4 and 5, for example, the first core half 220 comprises a first core main half body portion 230 having a first end surface 232, a second end surface 234, an outer surface 236, an inner surface 238, a lower surface 240 and an upper surface 242. The first core main half body portion 230 may also be referred to as a main core body 230 or a main body portion 230. The inner surface 238 may be a single fixed distance from the outer surface 236. In the illustrated embodiment, the inner surface 238 is divided into first and second inner surfaces 238A, 238B, respectively, as shown in FIGS. 4-7. The first inner surface 238A is spaced apart from the outer surface 236 by a first distance D1. The first distance D1 may be referred to as a first thickness D1. The second inner surface 238B is spaced apart from the outer surface by a second distance D2. The second distance D2 may be referred to as a second thickness D2. The first distance D1 may be larger, smaller, or the same as the second distance D2. As illustrated, the first distance D1 is greater than the second distance D2.

A first outer leg 250 of the first core half 220 extends perpendicularly from the inner surface 238 of the main body portion 230 near the first end surface 232 of the main body portion. As shown in FIG. 5, the first outer leg has a first outer leg end surface 252. The first outer leg has an outer lateral surface 254 and an inner lateral surface 256. In the illustrated embodiment, the outer lateral surface of the first outer leg is coplanar with the first end surface 232 of the main body portion. The inner lateral surface of the first outer leg is parallel to the outer lateral surface of the first outer leg. The first outer leg further includes a first outer leg cross-sectional profile 258 defined by the first outer leg end surface 252. The first outer leg cross-sectional profile has a first outer leg cross-sectional area. In the illustrated embodiment, the first outer leg has a lower surface coplanar with the lower surface 240 of the main body portion and has an upper surface coplanar with the upper surface 242 of the main body portion. The common upper and lower surfaces of the first outer leg and the other legs described in the following paragraphs are not numbered separately.

A second outer leg 260 of the first core half 220 extends perpendicularly from the inner surface 238 of the main body portion 230 near the second end surface 234 of the main body portion. The second outer leg has a second outer leg end surface 262. The second outer leg has an outer lateral surface 264 and an inner lateral surface 266. In the illustrated embodiment, the outer lateral surface of the second outer leg is coplanar with the second end surface 234 of the main body portion. The inner lateral surface of the second outer leg is parallel to the outer lateral surface of the second outer leg. The second outer leg further includes a second outer leg cross-sectional profile 268 defined by the second outer leg end surface 262. The second outer leg cross-sectional profile has a second leg cross-sectional area. In the illustrated embodiment, the second outer leg has a lower surface coplanar with the lower surface 240 of the main body portion and has an upper surface coplanar with the upper surface 242 of the main body portion.

A middle leg 270 of the first core half 220 extends perpendicularly from the inner surface 238 of the main body portion 230 between the first end surface 232 and the second end surface 234 of the main body portion. The middle leg has a middle leg end surface 272. The middle leg end surface may be positioned at least as far as each of the first and second outer leg end surfaces 252, 262 are from the outer surface 236 of the main body portion 230. The middle outer leg has a first lateral surface 274 and a second lateral surface 276. The first lateral surface faces toward the first end surface of the main body portion. The second lateral surface faces toward the second end surface of the main body portion. The first lateral surface and the second lateral surface are parallel to each other and parallel to the first and second end surfaces of the main body portion. The middle leg further includes a middle leg cross-sectional profile 278 defined by the middle leg end surface 272. The middle leg cross-sectional profile has a middle leg cross-sectional area. The middle leg cross-sectional area is greater than or equal to a sum of the first outer leg cross-sectional area and the second outer leg cross-sectional area. In the illustrated embodiment, the middle leg has a lower surface coplanar with the lower surface 240 of the main body portion and has an upper surface coplanar with the upper surface 242 of the main body portion.

Figure 6:
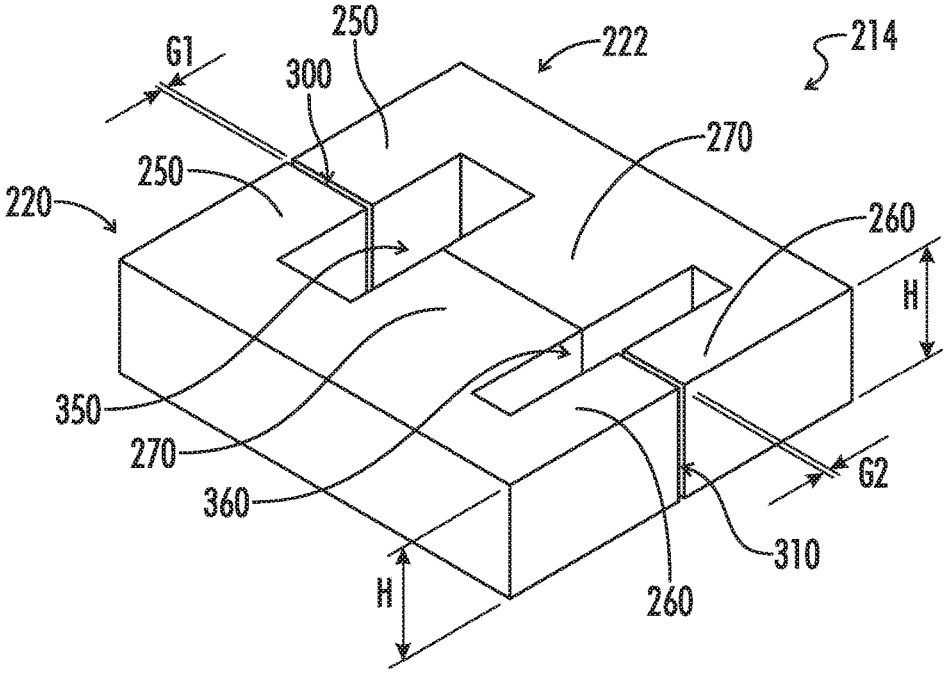
FIG. 6 illustrates an upper front perspective view of the first and second core halves juxtaposed to show the winding windows formed between the legs of the two core halves of the magnetic component of FIG. 3 and further showing the gaps between the adjacent ends of the outer legs.

As further shown in FIG. 6, the second core half 222 is configured the same or substantially the same as the first core half 220; and the elements of the body portion and legs of the second core half are numbered the same as the corresponding elements of the first core half. In the illustrated embodiment, the first and second core halves are mirror images; and the end surface 252 of the first outer leg 250 of the first core half is juxtaposed with the end surface 252 of the first outer leg 250 of the second core half as shown.

Figure 7:
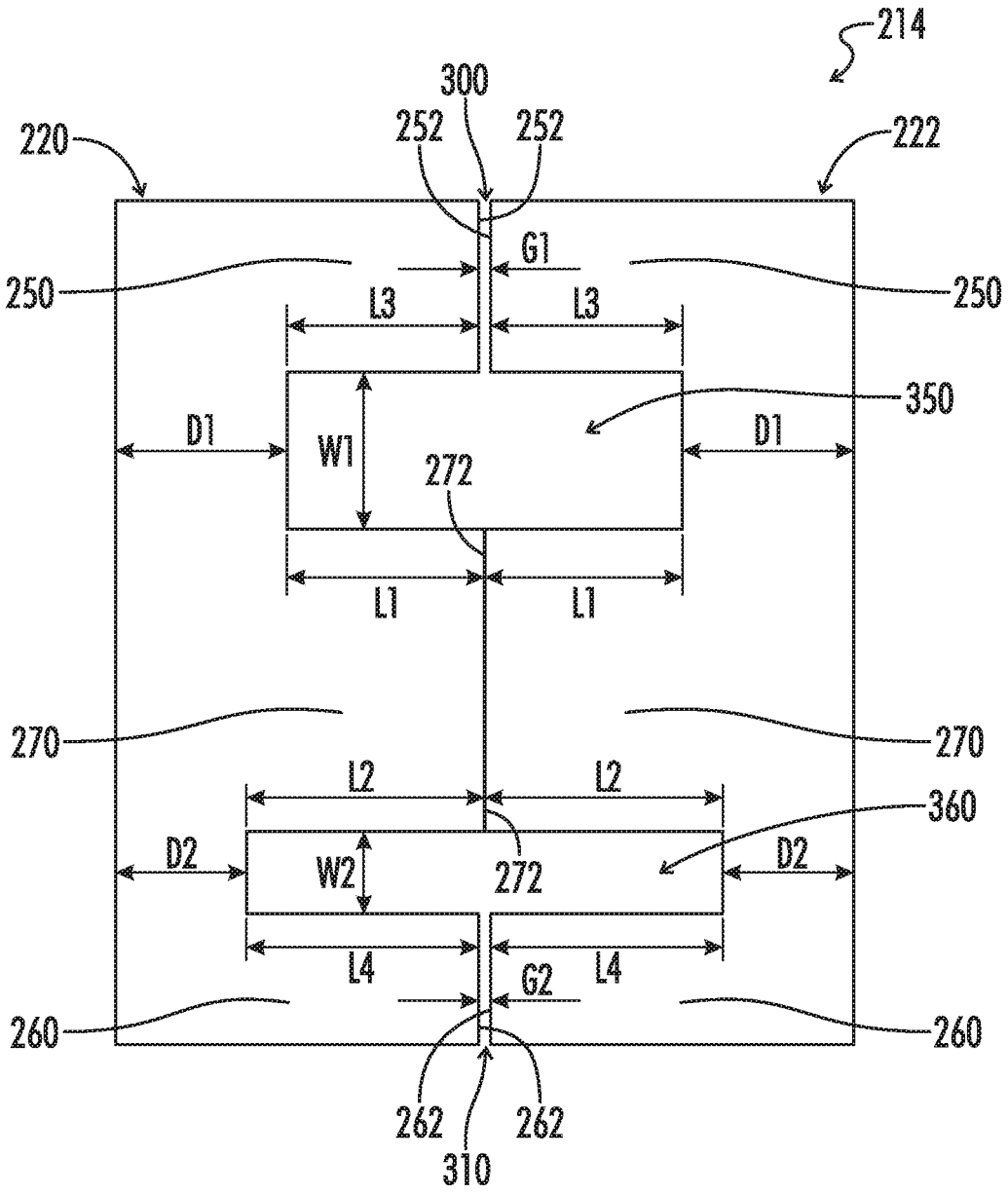
FIG. 7 illustrates a top plan view of the first and second core halves juxtaposed to show the common lengths of the legs of the two core halves of the magnetic component of FIG. 3.
Figure 8:
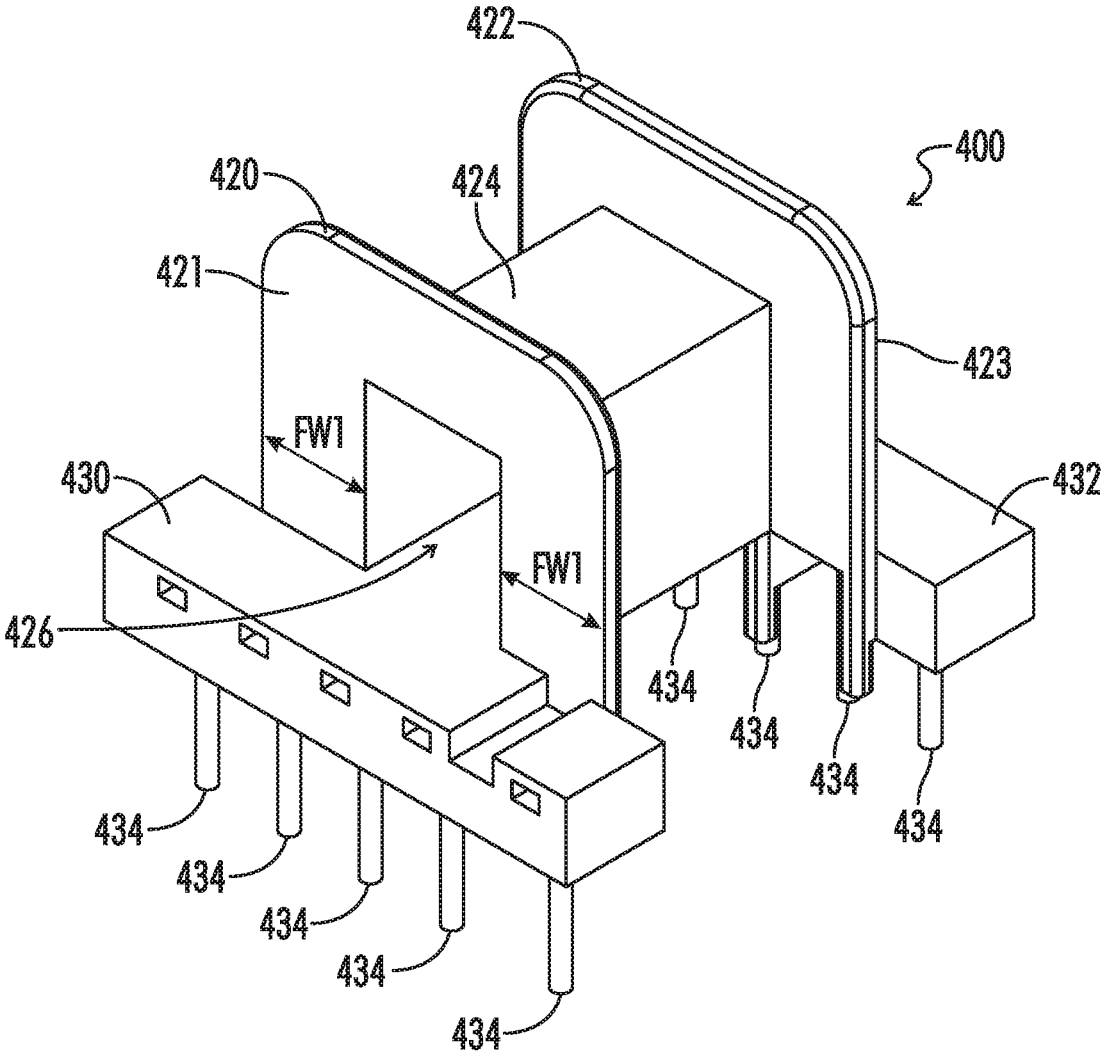
FIG. 8 illustrates an upper front perspective view of the first bobbin of the leftmost magnetic component of FIG. 3.
Figure 9:
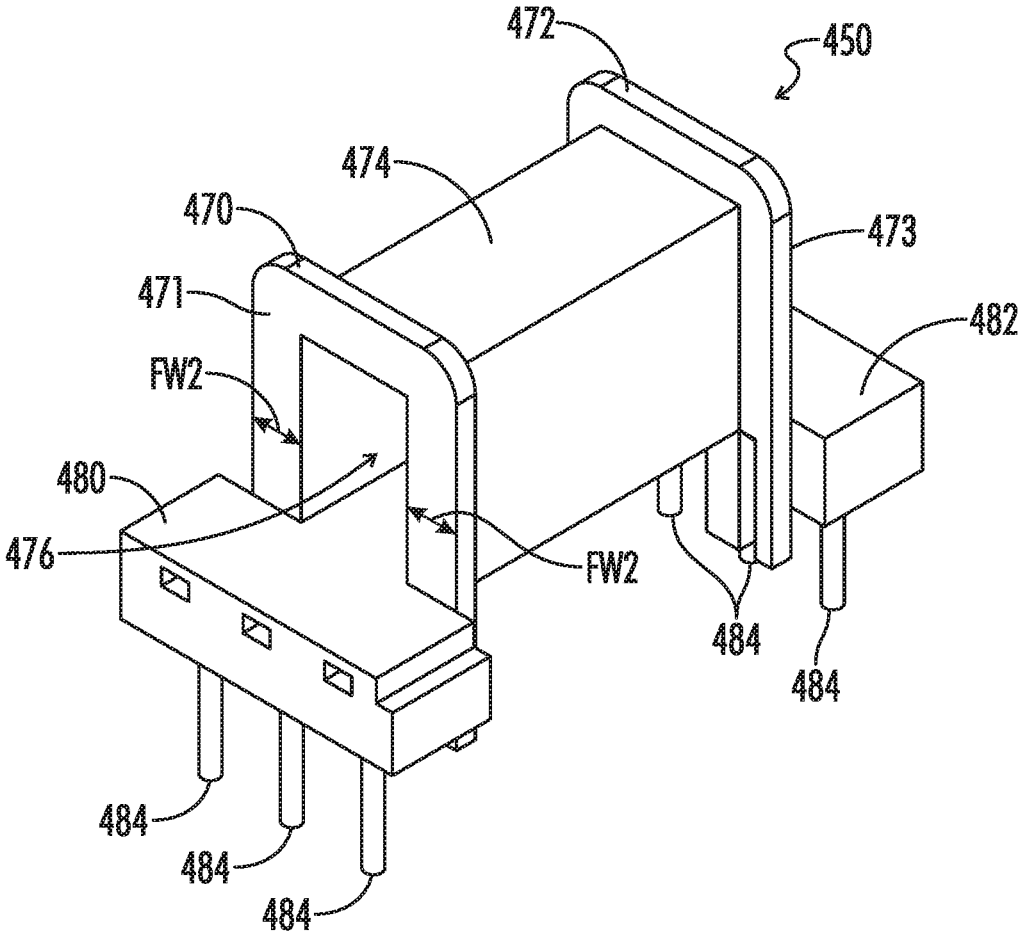
FIG. 9 illustrates an upper front perspective view of the second bobbin of the rightmost magnetic component of FIG. 3.

When the two core halves 220, 222 of the core structure 216 are mated as shown in FIGS. 6 and 7, the respective end surfaces 252 of the first outer legs 250 of the two core halves are positioned adjacent to each other; the respective end surfaces 262 of the second outer legs 260 of the two core halves are positioned adjacent to each other; and the respective end surfaces 272 of the middle legs 270 of the two core halves are positioned adjacent to each other. As described below, the respective end surfaces of the respective middle legs are abutting. The respective end surfaces of the respective outer legs may be spaced apart. As illustrated, the respective end surfaces of the respective outer legs are spaced apart to form the gaps described above.

In the illustrated embodiment, the main body portion 230 and the three legs 250, 260, 270 extending from the main body portion of each core half 220, 222 have a common height H (FIGS. 5 and 6). The main body portion includes a first main core body cross-sectional area and a second main core body cross-sectional area. The first main core body cross-sectional area is defined between the outer surface 236 and the first inner surface 238A of the main body portion 230 of each core half. The first main core body cross-sectional area is substantially equal to the common height H multiplied by the first distance D1. The first main core body cross-sectional area is at least as great as the first outer leg cross-sectional area. The second main core body cross-sectional area is defined between the outer surface 236 and the second inner surface 238B of the main body portion 230 of each core half. The second main core body cross-sectional area is substantially equal to the common height multiplied by the second distance D2. The second main core body cross-sectional area is at least as great as the second outer leg cross-sectional area.

In the illustrated embodiment, the middle leg 270 of each core half 220, 222 has a first common selected length L1 (FIG. 7) such that when the two core halves are mated as shown in FIGS. 6 and 7, the respective end surfaces 272 of the middle legs of the two core halves touch (e.g., abut). The first common selected length L1 is defined along the first lateral surface 274 (FIG. 5) of the middle leg 270 of each core half 220, 222 and measured between the end surface 272 and the first inner surface 238A. The middle leg of each core half has a second common selected length L2 (FIG. 7) defined along the second lateral surface 276 (FIG. 5) of the middle leg 270 of each core half 220, 222 and measured between the end surface 272 and the second inner surface 238B.

In the illustrated embodiment, the first outer legs 250 of the two core halves 220, 222 have a third common selected length L3 (FIG. 7) that is shorter than the first common selected length L1. The third common selected length L3 is defined along the inner lateral surface 256 (FIG. 5) of the first outer leg 250 of each core half 220, 222 and is measured between the end surface 252 and the first inner surface 238A. The third common selected length L3 is selected relative to the first common selected length L1 such that when the two core halves are mated as shown in FIGS. 6 and 7, the respective end surfaces 252 of the first outer legs are spaced apart from each other by a first gap 300 that is determined by the sum of the leg length differences. For example, if the first common selected length is L1 and the third common selected length is L3, a gap width G1 of the first gap 300 is calculated as G1=2×(L1−L3). The gap width G1 may be referred to as a first gap distance G1. The first common selected length is greater than the third common selected length by one-half of the first gap distance G1.

In the illustrated embodiment, the second outer legs 260 of the two core halves 220, 222 have a fourth common selected length L4 (FIG. 7) that is shorter than the second common selected length L2. The fourth common selected length L4 is defined along the inner lateral surface 266 (FIG. 5) of the second outer leg 200 of each core half 220, 222 and is measured between the end surface 262 and the second inner surface 238B. The fourth common selected length L4 is selected relative to the second common selected length L2 such that when the two core halves are mated as shown in FIGS. 6 and 7, the respective end surfaces 262 of the second outer legs are spaced apart from each other by a second gap 310 that is determined by the sum of the leg length differences. For example, if the second common selected length is L2 and the fourth common selected length is L4, a gap width G2 of the first gap 310 is calculated as G2=2−(L2−L4). The gap width G2 may be referred to as a second gap distance G2. The second common selected length is greater than the fourth common selected length by one-half of the second gap distance G2.

In the illustrated embodiment, the gap width G1 of the first gap 300 and the gap width G2 of the second gap 310 are shown as being approximately the same width; however, the first, second, third, and fourth common lengths may be selected such that the gap widths are different. For example, in one embodiment, the difference between the first common selected length of the middle legs 270 and the third common selected length of the first outer legs 250 may differ from the difference between the second common length of the middle legs 270 and the fourth common selected length of the second outer legs 260 such that the first gap width G1 and the second gap width G2 may be different. The first gap width G1 may be greater or smaller than the second gap width G2. Alternatively, the difference between the first common selected length of the middle legs 270 and the third common selected length of the first outer legs 250 may be equal to the difference between the second common length of the middle legs 270 and the fourth common selected length of the second outer legs 260 such that the first gap width G1 and the second gap width G2 may be the same. It should be understood that the gap widths illustrated in the figures may be exaggerated so that the gaps may be visualized. In certain embodiments, the gap widths may be a small percentage of the lengths of the respective legs. For example, a gap may have a width of less than 0.001 inch or may have a width of more than 0.01 inch.

As further shown in FIGS. 6 and 7, the juxtaposition of the end surfaces of the three legs forms two winding windows in the core structure 214. A first winding window 350 is formed between the juxtaposed first outer legs 250 and the juxtaposed middle legs 270. The first winding window has a width W1 determined by the leg spacing between the respective inner lateral surfaces 256 of the first outer legs and the respective first lateral surfaces 274 of the middle legs. The first winding window has a respective length determined by two times the first common length L1.

A second winding window 360 is formed between the juxtaposed second outer legs 260 and the juxtaposed middle legs 270. The second winding window has a width W2 determined by the leg spacing between the respective inner lateral surfaces 266 of the second outer legs and the respective second lateral surfaces 376 of the middle legs. The second winding window has a respective length determined by two times the second common length L2.

In the illustrated embodiment, the main body portion 230 of each core half 220, 222, has a width from the first end 232 to the second end 234 of approximately 1.128 inches. The main body portion and the three legs 250, 260, 270 extending from the main body portion have a common height from the lower surface 240 to the upper surface 242 of approximately 0.283 inch. The first outer leg 250 has a width of approximately 0.229 inch and the second outer leg 260 has a width of approximately 0.175 inch. The middle leg 270 has a width of approximately 0.404 inch. The width of the middle is equal to at least the sum of the width of the first outer leg and the width of the second outer leg.

The inner lateral surface 256 of the first outer leg 250 and the first lateral surface 274 of the middle leg 270 are spaced apart by a leg spacing of approximately 0.21 inch, which corresponds to the width W1 of the first winding window 350. The inner lateral surface 266 of the second outer leg 260 and the second lateral surface 276 of the middle leg 270 are spaced apart by a leg spacing of approximately 0.11 inch, which corresponds to the width W2 of the second winding window 360. In the illustrated embodiment, the two winding window widths differ; however, in other embodiments, the widths of the two winding windows may be the same or substantially the same.

Each of the core halves 220, 222 has a maximum length from the outer surface 236 of the main core body 230 to the end surface 272 of the middle leg 270. In the illustrated embodiment, the maximum length is approximately 0.493 inch.

The main body portion 230 has a thickness from the outer surface 236 to the inner surface 238 that differs in accordance with the location. In the illustrated embodiment, the main body portion has a thickness of approximately 0.229 inch in a first region between the inner lateral surface 256 of the first outer leg 250 and the first lateral surface 274 of the middle leg 270, which corresponds to the first winding window 350. The main body portion has a thickness of approximately 0.175 inch in a second region between the second lateral surface 276 of the middle leg and the inner lateral surface 266 of the second outer leg 260, which corresponds to the second winding window 360.

When the first core half 220 and the second core half 222 are mated as illustrated in FIGS. 6 and 7, the respective end surfaces 272 of the middle legs 270 of the two core halves abut. In the illustrated embodiment, the first winding window 350 has a length of approximately 0.528 inch determined by twice the difference between the overall length of each core section (e.g., 0.493 inch in the illustrated embodiment) and the thickness of the main body portion 230 in the first region as described above (e.g., 0.229 inch in the illustrated embodiment). In the illustrated embodiment, the second winding window 360 has a length of approximately 0.636 inch determined by twice the difference between the overall length of each core section (e.g., 0.493 inch in the illustrated embodiment) and the thickness of the main body portion 230 in the second region as described above (e.g., 0.175 inch in the illustrated embodiment).

Figure 10:
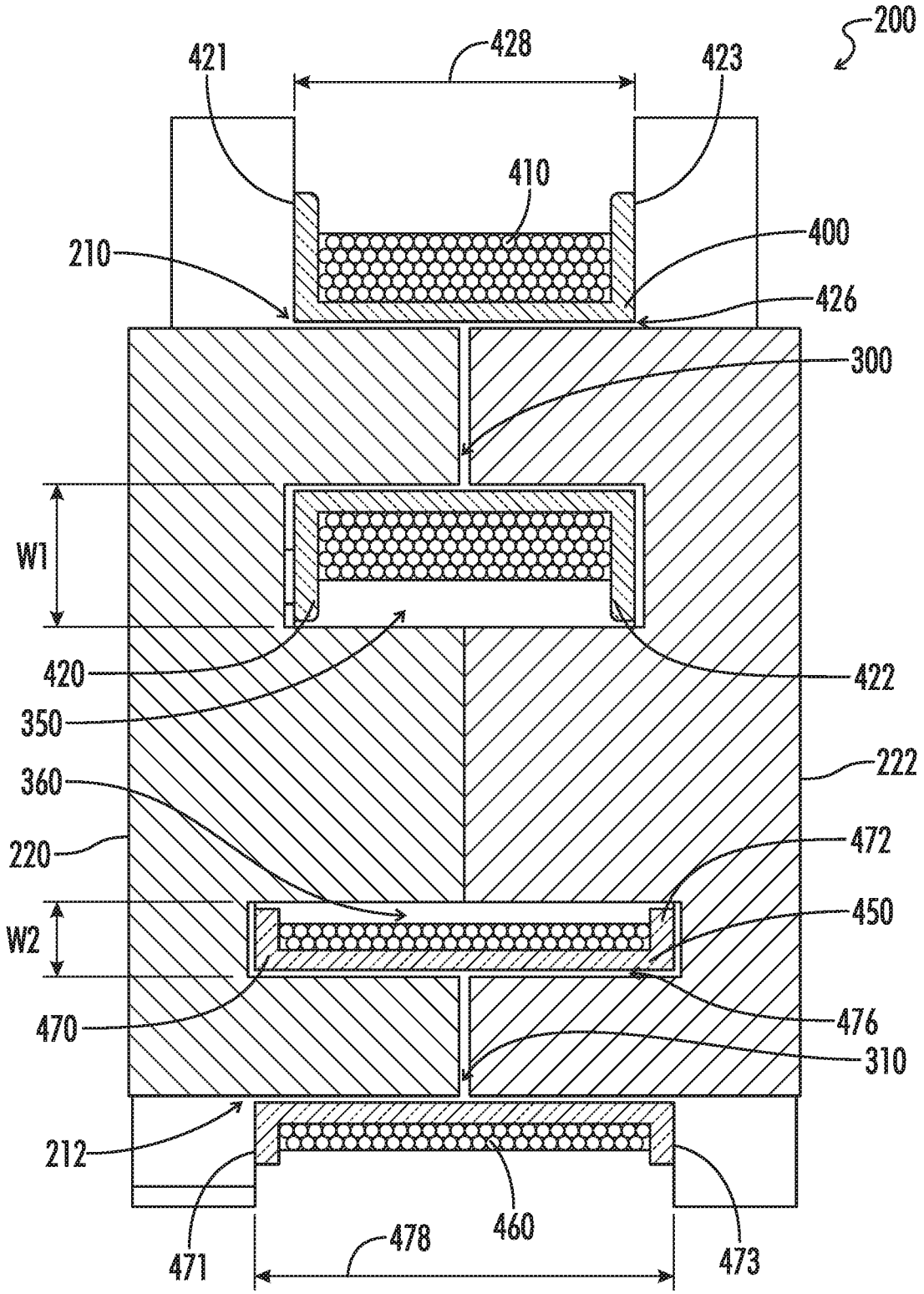
FIG. 10 illustrates a top plan cross-sectional view of the magnetic assembly of FIG. 3 taken along the line 10-10 of FIG. 3 showing the gaps between the ends of the outer legs of the core structure positioned within the passageways of the first and second bobbins of the leftmost and the rightmost magnetic components.

As shown in FIG. 3, the first (leftmost) magnetic component 210 comprises a first bobbin 400 having a first winding 410. The first bobbin is shown in more detail in FIG. 8 with the winding removed. The first bobbin includes a first end flange 420 and a second end flange 422. A coil winding surface 424 extends between the first end flange and the second end flange. The coil winding surface surrounds a core leg receiving passageway 426. As shown in FIG. 10, the passageway 426 has a passageway length 428 defined between an outer surface 421 of the first end flange 420 and an outer surface 423 of the second end flange 422. The outer surfaces of the first end flange and the second end flange of the first bobbin are spaced apart by the passageway length which is selected to be less than the length of the first winding window 350 of the mated core halves 220, 222 as shown in FIG. 10. Each flange has a width FW1 between the passageway and a lateral outer periphery of the flange that is selected to be no more than the width of the first winding window.

A first pin (or terminal) rail 430 extends from the first end flange 420. A second pin (or terminal) rail 432 extends from the second end flange 422. Each pin rail supports a plurality of pins (or terminals) 434. Selected ones of the pins are electrically connected to the first winding 410 (FIGS. 3 and 10) by conductors (not shown) in a conventional manner.

As shown, for example, in the cross-sectional view in FIG. 10, the passageway 426 of the first bobbin 400 has a shape and a size configured to receive the first outer legs 250 of the first and second core halves 220, 222 such that the first gap 300 formed by the juxtaposed end surfaces 252 of the first outer legs is positioned approximately in the middle of the passageway between the first end flange 420 and the second end flange 422. As such, the first outer leg cross-sectional profile 258 is configured to fit with the passageway of the first bobbin 400. When positioned as shown in FIG. 3 (facing the first end flange 420), the respective rightmost portions of the flanges and the rightmost portion of the winding 410 fit within the first winding window 350 (FIG. 10).

As shown in FIG. 3, the second (rightmost) magnetic component 212 comprises a second bobbin 450 having a second winding 460. The second bobbin is shown in more detail in FIG. 9 with the winding removed. The second bobbin includes a first end flange 470 and a second end flange 472. A coil winding surface 474 extends between the first end flange and the second end flange. The coil winding surface surrounds a core leg receiving passageway 476. As shown in FIG. 10, the passageway 476 has a passageway length 478 defined between an outer surface 471 of the first end flange 470 and an outer surface 473 of the second end flange 472. The outer surfaces of the first end flange and the second end flange of the second bobbin are spaced apart by the passageway length, which is selected to be less than the length of the second winding window 360 of the mated core halves 220, 222 as shown in FIG. 10. Each flange has a width FW2 between the passageway and a lateral outer periphery of the flange that is selected to be no more than the width of the second winding window.

A first pin (or terminal) rail 480 extends from the first end flange 470. A second pin (or terminal) rail 482 extends from the second end flange 472. Each pin rail supports a plurality of pins (or terminals) 484. Selected ones of the pins are electrically connected to the second winding 460 (FIGS. 3 and 10) by conductors (not shown) in a conventional manner.

As shown, for example, in the cross-sectional view in FIG. 10, the passageway 476 of the second bobbin 450 has a shape and a size configured to receive the second outer legs 260 of the first and second core halves 220, 222 such that the second gap 310 formed by the juxtaposed end surfaces 252 of the first outer legs is positioned approximately in the middle of the passageway between the first end flange 470 and the second end flange 472. As such, the second outer leg cross-sectional profile 268 is configured to fit with the passageway of the second bobbin 450. When positioned as shown in FIG. 3 (facing the first end flange 470), the respective leftmost portions of the flanges and the leftmost portion of the winding 460 fit within the second winding window 360 (FIG. 10).

As further shown in FIG. 10, the middle leg 270 of each core half 220, 222, is configured to span between the first bobbin 400 and the second bobbin 450.

Figure 11:
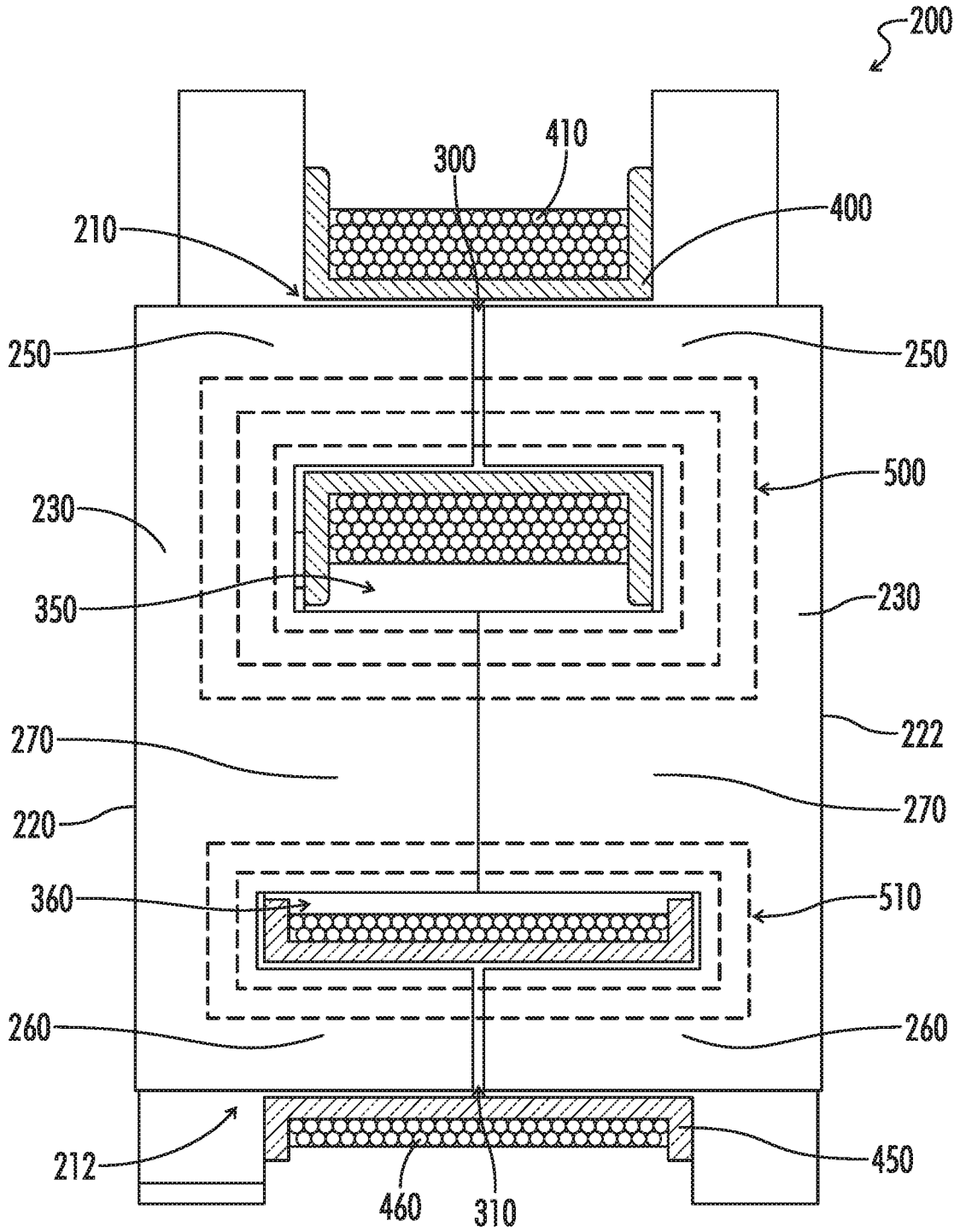
FIG. 11 pictorially illustrates the flux paths within the bodies and the legs of the two core halves of the core structure of the single magnetic assemblies caused by the two independent magnetic components.

FIG. 11 pictorially represents the flux paths through the core structure 216 generated by the respective windings 410, 460 of the magnetic components 210, 212. As shown, the flux generated by the first winding 410 follows a first flux path 500, which passes through the first outer legs 250 positioned within the passageway 426 of the first bobbin 400 onto which the first winding is wound, including the first gap 300. The first flux path passes through a region of the main body portion 230 of the first core half 220 to the middle legs 270; passes through the middle legs 270; passes through a region of the main body portion 230 of the second core half 222; and passes back to the first outer legs positioned within the first winding. Accordingly, the first flux path encompasses the first winding window 350.

Similarly, the flux generated by the second winding 460 follows a second flux path 510, which passes through the second outer legs 260 positioned within the passageway 476 of the second bobbin 450 onto which the second winding is wound, including the second gap 310. The second flux path passes through a region of the body portion 230 of the first core half 220 to the middle legs 270; passes through the middle legs; passes through a region of the body portion 230 of the second core half 222; and passes back to the second outer legs positioned within the second winding. Accordingly, the second flux path encompasses the second winding window 360.

As illustrated in FIG. 11, the flux generated by the first winding 410 passes along the first flux path 500 through the middle legs 270 with the flux from the second winding 460. The cross-sectional areas of the middle legs are selected to be sufficiently great such that the middle legs are able to accommodate the flux generated by the two windings without exceeding a desired flux density. As stated above, the cross-sectional area of the middle leg is equal to at least the cross-sectional area of the first outer leg 250 plus the cross-sectional area of the second outer leg 260. As further illustrated in FIG. 11, the flux generated by two sources pass through the middle leg along independent flux paths within separate portions of the middle leg and do not interact.

Figure 1A:
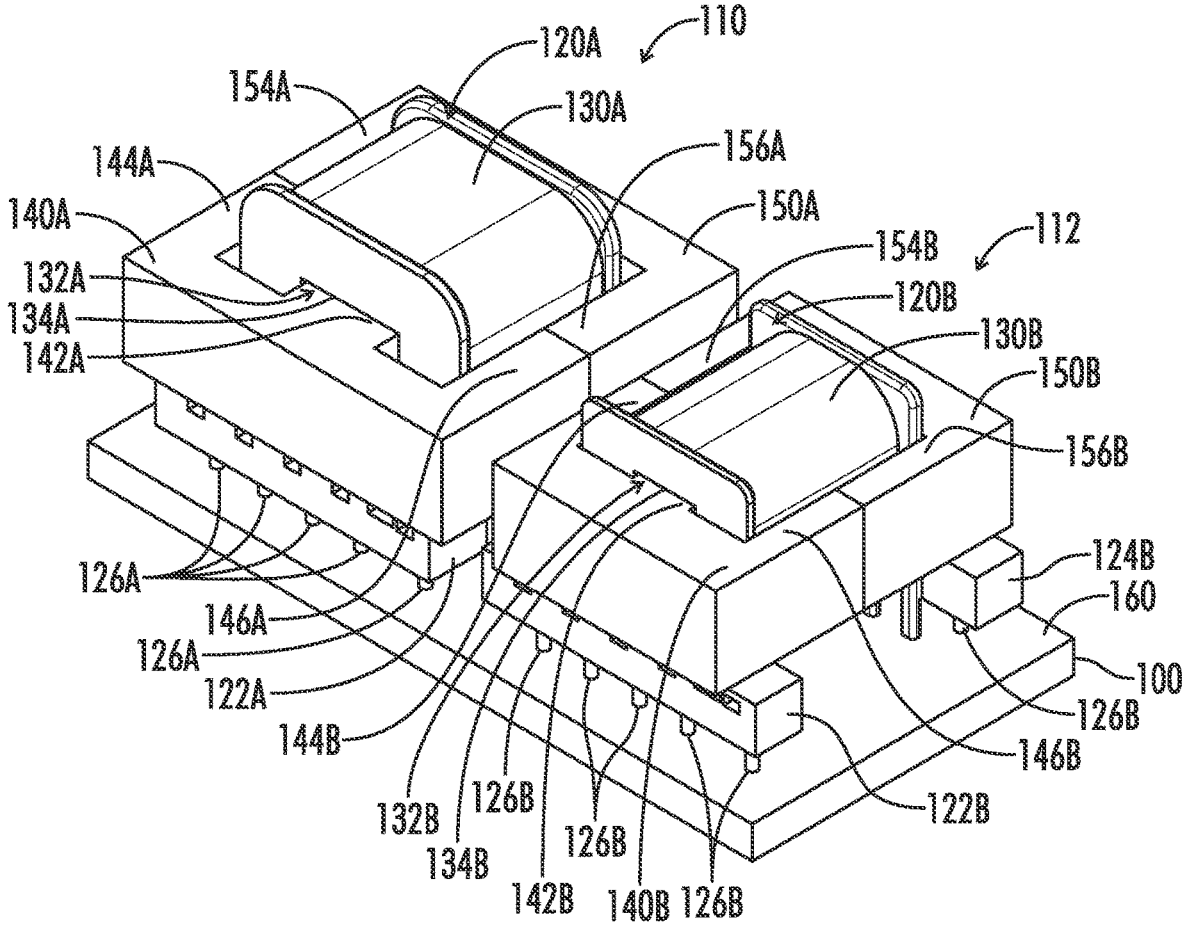
FIG. 1A (PRIOR ART)
FIG. 1A illustrates a perspective view of a conventional printed circuit board with two independent magnetic assemblies positioned thereon.
Figure 1B:
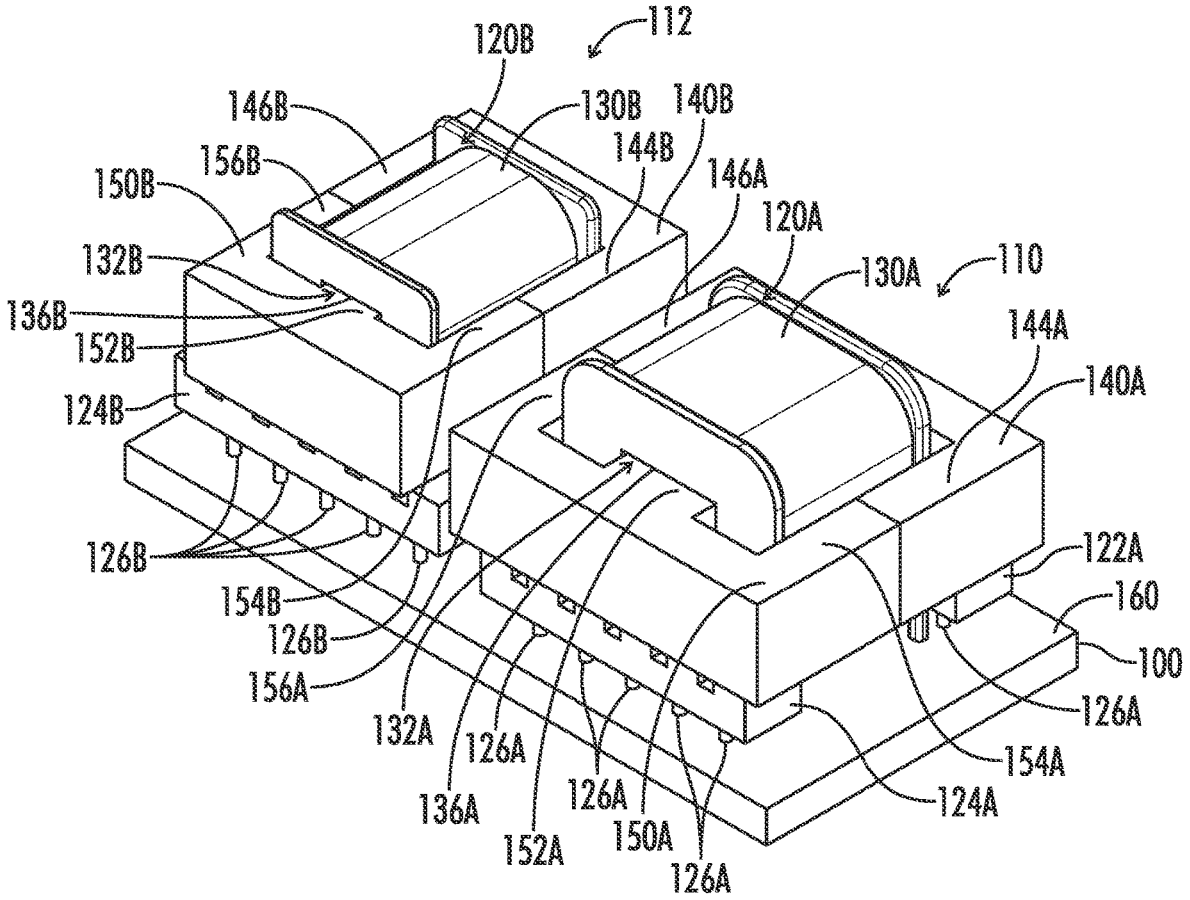
FIG. 1B (PRIOR ART)
FIG. 1B illustrates a rear perspective view of the printed circuit board and the magnetic assemblies of FIG. 1A.
Figure 2:
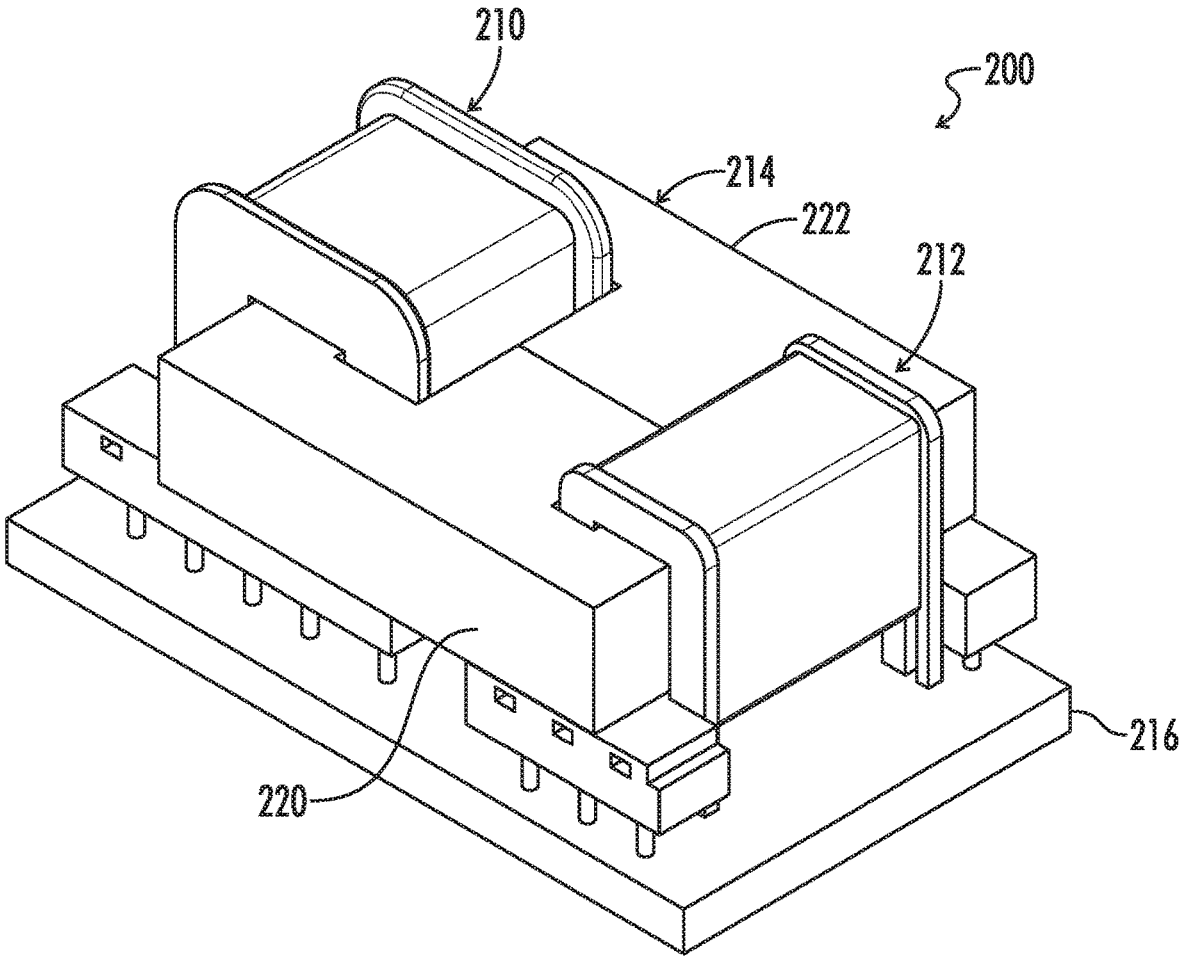
FIG. 2 illustrates an upper front perspective view of a single magnetic assembly mounted on a printed circuit board wherein the single magnetic assembly comprises two independent magnetic components sharing a common core structure.
Figure 12:
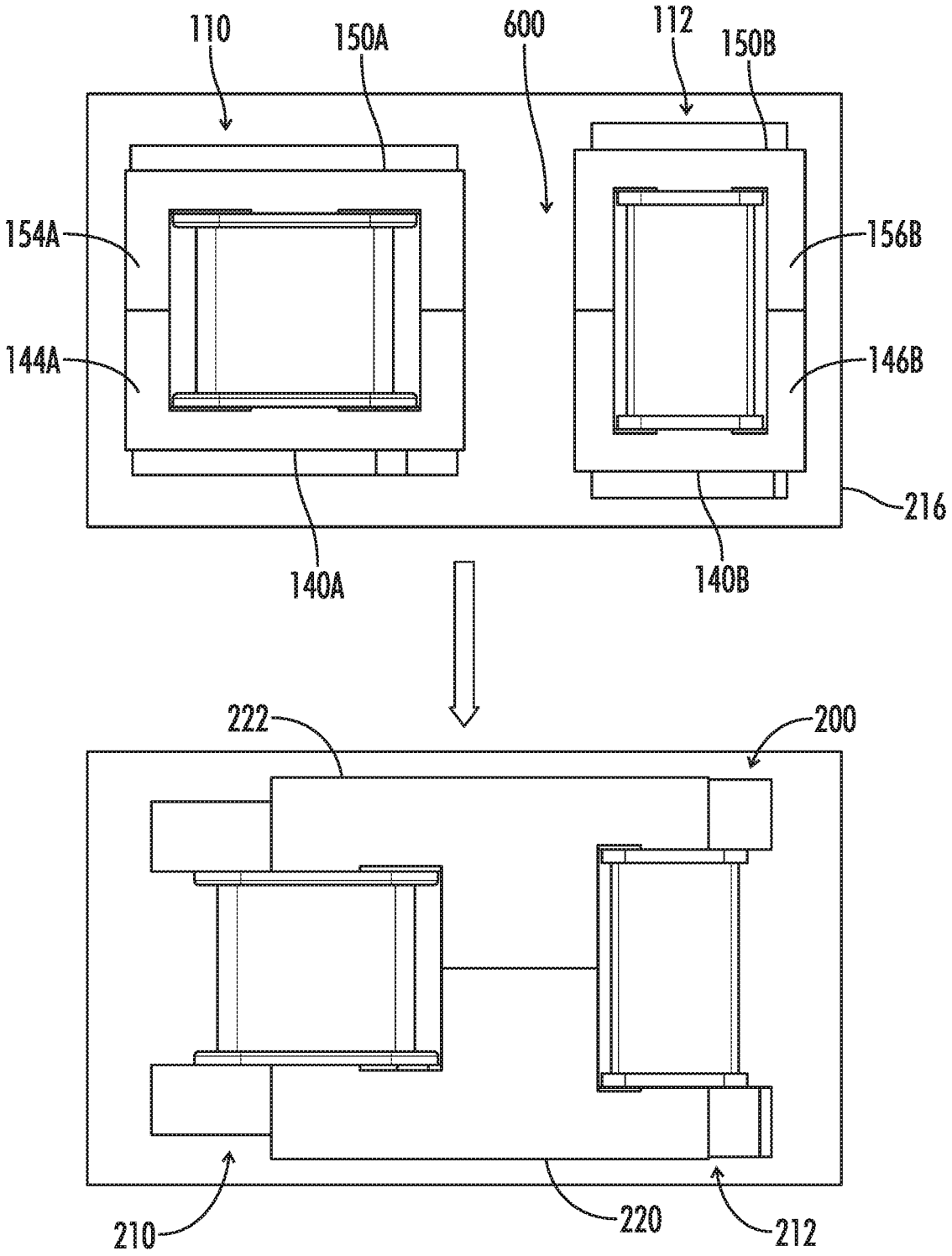
FIG. 12 pictorially compares the single magnetic assembly of FIG. 2 with the two separate magnetic assembly of FIGS. 1A and 1B.

One benefit of the magnetic assembly 200 disclosed herein is illustrated pictorially in FIG. 12, which shows the first magnetic assembly 110 and the second magnetic assembly 112 of FIGS. 1A and 1B replaced with the single magnetic assembly 200 of FIG. 2. As illustrated, a structural gap 600 between the first magnetic assembly and the second magnetic assembly is eliminated by the improved single core structure. Furthermore, the new core structure eliminates the first outer legs 144A, 154A of the E-cores of the first magnetic assembly and the second outer legs 146C, 156C of the E-cores of the second magnetic assembly. Thus, the overall structure requires less area on a printed circuit board. Furthermore, the installation steps are reduced by having to install only a single magnetic component instead of three magnetic components.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A magnetic assembly having two independent magnetic components sharing a common core structure, the magnetic assembly comprising:

a first bobbin including a first respective winding surrounding a respective first passageway, the first passageway having a respective first end and a respective second end, the first bobbin further including a respective first end flange and a respective second end flange positioned at opposite ends positioned at the first end of the first passageway and a respective second flange positioned at the second end of the first passageway, the first passageway having a respective first passageway length defined between a respective outer surface of the first end flange of the first bobbin and a respective outer surface of the second end flange of the first bobbin;

a second bobbin including a second respective winding surrounding a respective second passageway, the second passageway having a respective first end and a respective second end, the second bobbin further including a respective first end flange and a respective second end flange positioned at opposite ends positioned at the first end of the second passageway and a respective second end flange positioned at the second end of the second passageway, the second passageway having a respective second passageway length defined between a respective outer surface of the first end flange of the second bobbin and a respective outer surface of the second end flange of the second bobbin; and a first core half and a second core half, each of the first core half and second core half including:

a main core body of the first core half extending between a first end surface of the main core body of the first core half and a second end surface of the main core body of the first core half, the main core body of the first core half having a respective outer surface, a respective first inner surface and a respective second inner surface;

a first outer leg of the first core half extending perpendicularly from the first inner surface of the main core body of the first core half, the first outer leg of the first core half positioned proximate to the first end surface of the main core body of the first core half, the first outer leg of the first core half having a first outer leg cross-sectional profile configured to fit within the passageway of the first bobbin, the first outer leg cross-sectional profile defining a first outer leg cross-sectional area, the first outer leg positioned within the first passageway of the first bobbin via the first end of the first passageway;

a second outer leg of the first core half extending perpendicularly from the second inner surface of the main core body of the first core half, the second outer leg of the first core half positioned proximate to the second end surface of the main core body of the first core half, the second outer leg of the first core half having a second outer leg cross-sectional profile configured to fit within the passageway of the second bobbin, the second outer leg cross-sectional profile defining a second outer leg cross-sectional area, the second outer leg cross-sectional profile different from the first outer leg cross-sectional profile, the second outer leg cross-sectional area greater than the first outer leg cross-sectional area, the second outer leg positioned within the second passageway of the second bobbin via the first end of the second passageway; and a middle leg of the first core half extending perpendicularly from the first and second inner surface surfaces of the main core body of the first core half to a first middle leg end surface, the middle leg of the first core half positioned between the first outer leg of the first core half and the second outer leg of the first core half, the middle leg of the first core half spaced apart from the first outer leg of the first core half by a first window width, the middle leg of the first core half spaced apart from the second outer leg of the first core half by a second window width, the middle leg having a middle leg end surface, the middle leg of the first core half having a middle leg cross-sectional profile defining a middle leg cross-sectional area, the middle leg cross-sectional area being at least as great as a sum of the first outer leg cross-sectional area and the second outer leg cross-sectional area;

and a second core half, the second core half including:

a main core body of the second core half extending between a first end surface of the main core body of the second core half and a second end surface of the main core body of the second core half, the main core body of the first core half having a respective outer surface, a respective first inner surface and a respective second inner surface;

a first outer leg of the second core half extending perpendicularly from the first inner surface of the main core body of the second core half, the first outer leg of the second core half positioned proximate to the first end surface of the main core body of the second core half, the first outer leg of the second core half having the first outer leg cross-sectional profile and the first outer leg cross-sectional area, the first outer leg of the second core half positioned within the first passageway of the first bobbin via the second end of the first passageway;

a second outer leg of the second core half extending perpendicularly from the second inner surface of the main core body of the second core half, the second outer leg of the second core half positioned proximate to the second end surface of the main core body of the second core half, the second outer leg of the second core half having the second outer leg cross-sectional profile and the second outer leg cross-sectional area, the second outer leg of the second core half positioned within the second passageway of the second bobbin via the second end of the second passageway; and a middle leg of the second core half extending perpendicularly from the first and second inner surfaces of the main core body of the second core half to a second middle leg end surface, the middle leg of the second core half positioned between the first outer leg of the second core half and the second outer leg of the second core half, the middle leg of the second core half spaced apart from the first outer leg of the second core half by the first window width, the middle leg of the second core half spaced apart from the second outer leg of the second core half by the second window width, the middle leg of the second core half having the middle leg cross-sectional profile and the middle leg cross-sectional area, the second middle leg end surface of the middle leg of the second core half positioned to abut the first middle leg end surface of the middle leg of the first core half, wherein the winding of the first bobbin positioned on the first outer legs of the first and second core halves and the winding of the second bobbin positioned on the second outer legs of the first and second core halves are the only windings of the magnetic assembly, wherein:

the main core body of each of the first core half and second core half includes a main core outer surface, a first main core inner surface, and a second main core inner surface, the first and second main core inner surfaces positioned opposite to the main core outer surface, the respective first main core inner surface of the main body of each core half is defined between the respective first outer leg and the respective middle leg, of each core half;

the respective second main core inner surface of the main body of each core half is defined between the respective middle leg and the respective second outer leg of each core half;

the respective middle leg of each of the first core half and the second core halves half includes a middle leg end surface, a respective first common length, and a respective second common length, the respective first common length defined between the respective first main core inner surface of the respective main body and the respective middle leg end surface, the respective second common length defined between the respective second main core inner surface of the respective main body and the respective middle leg end surface;

the respective first outer leg of each of the first core half and the second core halves half includes a respective first outer leg end surface and a respective third common length, the respective third common length defined between the respective first main core inner surface and the respective first outer leg end surface;

the respective second outer leg of each of the first core half and the second core halves half includes a respective second outer leg end surface and a respective fourth common length, the respective fourth common length defined between the respective second main core inner surface and the respective second outer leg end surface;

a total of the respective first common length of the respective middle leg of the first core half and the respective first common length of the respective middle leg of the second core half is greater than a total of the respective third common length of the respective first outer leg of the first core half and the respective third common length of the respective first outer leg of the second core half by one-half of a first gap distance; and a total of the respective second common length of the respective middle leg of the first core half and the respective second common length of the respective middle leg of the second core half is greater than a total of the respective fourth common length of the respective second outer leg of the first core half and the respective fourth common length of the respective second outer leg of the second core half by one-half of a second gap distance.

2. The magnetic assembly of claim 1, wherein:

each of the first and second end flanges of the first bobbin includes a first bobbin flange width defined between the passageway and a lateral outer periphery of the respective end flange, the first bobbin flange width being less than the first window width; and each of the first and second end flanges of the second bobbin includes a second bobbin flange width defined between the passageway and a lateral outer periphery of the respective end flange, the second bobbin flange width being less than the second window width.

3. The magnetic assembly of claim 1, wherein the main core body, the first outer leg, the second outer leg, and the middle leg of each of the first and second core halves have a selected common height.

4. The magnetic assembly of claim 1, wherein:

the first outer legs and the middle legs of the first and second core halves define a first winding window having the first window width and a first window length, the first window length defined between a respective the first main core inner surface of the main core body of the first core half and a respective the first main core inner surface of the main core body of the second core half; and a second winding window between the middle legs and the second outer legs of the first and second core halves, the second winding window including the second window width and a second window length, the second window length defined between a respective the second main core inner surface of the main core body of the first core half and a respective the second main core inner surface of the main core body of the second core half.

5. The magnetic assembly of claim 4, wherein:

the first window length is at least as great as the passageway length of the first bobbin;

the second window length is at least as great as the passageway length of the second bobbin; and one of the first window length and the second window length is greater than another of the first window length and the second window length.

6. The magnetic assembly of claim 1, wherein one of the first gap distance and the second gap distance is greater than another of the first gap distance and the second gap distance.

7. The magnetic assembly of claim 1, wherein one of the first window width and the second window width is greater than another of the first window width and the second window width.

8. The magnetic core of claim 1, wherein:

the respective main core body of each of the first core half and the second core half has a respective first main body thickness defined between the respective outer surface of the respective main core body and the respective first inner surface of the respective main core body, the first main body thickness being at least as great as a width of the respective first outer leg of the respective core half; and the respective main core body of each of the first core half and the second core half has a respective second main body thickness defined between the respective outer surface of the respective main core body and the respective inner surface of the respective main core body.

9. The magnetic core of claim 1, wherein:

the respective main core body of each of the first core half and the second core half has a respective first main core body cross-sectional area defined between the respective outer surface of the respective main core body and the respective first inner surface of the respective main core body, the respective first main core body cross-sectional area being at least as great as the respective first outer leg cross-sectional area of the respective core half; and the respective main core body of the first core half and the second core half has a respective second main core body cross-sectional area defined between the respective outer surface of the respective main core body and the respective second inner surface of the respective main core body, the respective second main core body cross-sectional area being at least as great as the respective second outer leg cross-sectional area of the respective core half.

10. The magnetic core of claim 1, wherein the first outer leg end surface of the first core half is spaced apart from the first outer leg end surface of the second core half by a first gap distance;

the second outer leg end surface of the first core half is spaced apart from the second outer leg end surface of the second core half by a second gap distance; and one of the first gap distance and the second gap distance is greater than another of the first gap distance and the second gap distance.

* * * * *